US007115349B2

(12) United States Patent
Iida et al.

(10) Patent No.: US 7,115,349 B2
(45) Date of Patent: Oct. 3, 2006

(54) TONER

(75) Inventors: Wakashi Iida, Ibaraki (JP); Kazuhiko Hayami, Shizuoka (JP); Takayuki Itakura, Shizuoka (JP); Yojiro Hotta, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 227 days.

(21) Appl. No.: 10/722,463

(22) Filed: Nov. 28, 2003

(65) Prior Publication Data

US 2004/0137353 A1 Jul. 15, 2004

(30) Foreign Application Priority Data

Nov. 29, 2002 (JP) ..... 2002-347286

(51) Int. Cl.
*G03G 9/08* (2006.01)

(52) U.S. Cl. ..... 430/108.24; 430/108.3; 430/108.4; 430/109.4; 430/111.4

(58) Field of Classification Search ..... 430/108.24, 430/108.3, 108.4, 109.4, 111.4
See application file for complete search history.

(56) References Cited

U.S. PATENT DOCUMENTS

| | | | | |
|---|---|---|---|---|
| 5,219,696 | A | 6/1993 | Demizu et al. | 430/110 |
| 5,604,071 | A | 2/1997 | Okado et al. | 430/110 |
| 5,635,326 | A | 6/1997 | Kanbayashi et al. | 430/110 |
| 5,814,429 | A * | 9/1998 | Kawakami et al. | 430/124 |
| 5,863,697 | A | 1/1999 | Uchiyama et al. | 430/137 |
| 5,922,500 | A * | 7/1999 | Iida et al. | 430/108.3 |
| 6,013,402 | A | 1/2000 | Kanbayashi et al. | 430/45 |
| 6,130,020 | A | 10/2000 | Wada et al. | 430/110 |
| 6,664,016 | B1 * | 12/2003 | Kanbayashi et al. | 430/108.23 |

FOREIGN PATENT DOCUMENTS

| | | | |
|---|---|---|---|
| EP | 0764889 | A2 | 3/1997 |
| EP | 1188714 | A1 | 3/2002 |
| EP | 1246022 | A2 | 10/2002 |
| JP | 04-204751 | | 7/1992 |
| JP | 04-280255 | | 10/1992 |
| JP | 04-345168 | | 12/1992 |
| JP | 04-345169 | | 12/1992 |
| JP | 04-348354 | | 12/1992 |
| JP | 05-19528 | | 1/1993 |
| JP | 05-61224 | | 3/1993 |
| JP | 05-113688 | | 3/1993 |
| JP | 05-94037 | | 4/1993 |
| JP | 05-119517 | | 5/1993 |
| JP | 05-129748 | | 6/1993 |
| JP | 06-11886 | | 1/1994 |
| JP | 06-11887 | | 1/1994 |
| JP | 11-174721 | | 7/1999 |
| JP | 11-174726 | | 7/1999 |
| JP | 2002-29730 | | 1/2002 |

* cited by examiner

*Primary Examiner*—Mark A. Chapman
(74) *Attorney, Agent, or Firm*—Fitzpatrick, Cella, Harper & Scinto

(57) ABSTRACT

Provided is toner which is excellent in developing property, transferring property, and fixing property, hardly affected by its surrounding, and has good endurance. The toner has a peak temperature of maximum endothermic peak in the range of 60 to 100° C. in an endothermic curve of differential scanning calorimetry (DSC) measurement;

silica particles in the toner contain a titanium element; and the silica particles satisfy the following expressions.

$$0.7 \leqq (Ia_1/Ib_1) \leqq 2.0$$

$$0.7 \leqq (Ia_2/Ib_2) \leqq 2.0$$

where $Ia_1$ represents a maximum intensity in the case of 2θ=25.3 deg, $Ib_1$ represents a mean intensity in the cases of 2θ=25.3 deg+2.0 deg. and of 2θ=25.3 deg.−2.0 deg., $Ia_2$ represents a maximum intensity in the case of 2θ=27.5 deg and $Ib_2$ represents a mean intensity in the cases of 2θ=27.5. deg+2.0 deg. and of 2θ=27.5 deg.−2.0 deg.

13 Claims, No Drawings

TONER

BACKGROUND OF THE INVENTION

1. Field of the Invention

The present invention relates to a toner to be used in image formation employing electrostatic charge development or a toner jet system in an image forming method such as an electrophotographic, electrostatic recording, or electrostatic printing method. In particular, the present invention relates to a color toner with which an image of high fineness and quality can be expressed even if a fixing means is used in which oil for preventing a high-temperature offset is not used or is somewhat used.

2. Description of the Related Art

In recent years, electrophotographic apparatuses have been requested to be constructed of more simplified components to meet a specification that states the necessary features upon image formation such as size and weight reductions and low power consumption while achieving colorization, high fineness, and high image quality.

Thus, image formation of a full-color image with high quality has been attempted in the art because of an increase in market demand for high fineness and quality of an image in electrophotography. In the case of a full-color electrophotographic image, three or four color toners are superimposed on one another to form a full-color image. However, if the color toners for the respective colors are not similarly developed and transferred, color reproduction may be deteriorated or color drift may occur. Those colors are formed with pigments or dyes, so that these materials will exert large influences on the development and the transfer. Furthermore, in a full-color image, fixing property, color mixing property, and offset resistance are important at the time of fixation, so that a binder resin suitable for these properties is selected. However, the binder resin will also exert large influences on the developing and transferring properties. The influences include those of temperature and humidity on the charge amount of toner. Therefore, there is an urgent need to develop a color toner having a stable charge amount even under various environments.

As a measure for solving such problems, there is a method in which various kinds of external additives are added to toners. In particular, for improving various image characteristics such as resolution, density uniformity, and fogging, the addition of various kinds of fine particles to toners to improve charging and transferring properties of the toners has been widely performed.

For such inorganic fine particles, the following are generally used: (i) inorganic fine particles whose surfaces have been treated with a silicone oil, a silicone varnish, or a silane compound; or (ii) inorganic fine particles including surface-treated titania and an inorganic fine particle whose surface has been treated with aminosilane (see JP 05-19528 A, JP 05-61224 A, JP 05-94037 A, JP 05-119517 A, JP 05-139748 A, JP 06-11886 A, and JP 06-11887 A).

Further, for the inorganic fine particles, (iii) those to which two types of inorganic fine particles are added are preferably used (see JP 04-204751 A, JP 04-280255A, JP 04-345168A, JP 04-345169A, JP 04-348354 A, and JP 05-113688 A).

However, even though each of those proposals allows an improvement in electrophotographic characteristics of toner, a sufficient triboelectric charging amount cannot be obtained as a result of standing under high humidity or for a long period with uniform hydrophobic processing being insufficient. Thus, a decrease in image density or fogging may occur. Alternatively, a frictional charge amount may become excessive under low humidity, causing an irregular image density or fogging. Furthermore, the transferring property of a toner is insufficient because the releasing property of the toner from a photoconductive drum to a transfer member is not sufficient. Thus, a decrease in transfer efficiency or a defect of transferred colorant may occur. In other words, there is no way for solving both of the problems. Furthermore, it is not at all satisfactory particularly when applied to a full-color toner.

In JP 01-31442 B, there is proposed a metal oxide powder with a low-bulk density to be provided as an external additive. In this case, the powder particle has an amino group and a hydrophobic group on its surface, where an OH group thereof is blocked, and a specific surface area thereof is at least 50 $m^2/g$. In addition, the surface of the powder particle is charged positive or uncharged. However, in this case, the charging property of the surface of the metal oxide powder is adjusted with a processing agent, so that the charge amount distribution on the surface of the metal oxide powder at the micro level may broaden or the charge amount distribution on the toner may broaden. Therefore, the method disclosed in the document is not preferable.

In each of JP 11-174721 A and JP 11-174726 A, there is disclosed a toner that contains oxides prepared by high-temperature vapor phase method of a silicon halogenated compound and a halogenated compound of a specific metal. In addition, titanium-containing silica is disclosed as the oxide prepared by high-temperature vapor phase method. The silica is vapor-phase oxidized under a high temperature, so that titanium therein can be of crystalline. In addition, the silica contains a large amount of a halogen component, which is inferred to exert an adverse effect. The content of a titanium compound can be high because the addition of titanium is only for the purpose of adjusting the charge of silica. In addition, there is no sufficient consideration given on the transferring property of toner having excellent low-temperature fixing property and oil-less fixing property, which are problems required to be improved.

Furthermore, in JP 2002-029730 A, there is proposed a method for controlling the charging property of the surface of silica particles by coating the surfaces of silica particles with a hydroxide or an oxide of titanium, zirconium, tin, or aluminum in an aqueous system, and subjecting the particles to a surface treatment with alkoxysilane in the aqueous system. However, it is difficult to provide the surfaces of silica particles with sufficient reactivity and adhesion even if the surfaces of silica particles are coated with a hydroxide or an oxide of titanium, zirconium, tin, or aluminum in the aqueous system. It is believed that the characteristics of a different metal existing near the surfaces of silica particles may exert a strong influence on the toner even if the surface treatment is completed favorably. In addition, the presence of such a metal significantly changes charging polarity and surface electric resistance of silica particles, exerting adverse effects on the charging property and charge amount distribution of the toner. Thus, such a method is unfavorable.

As described above, at present, there exists no toner that has good charging property, transferring property, fixing property, and durability while being hardly influenced by temperature and humidity, sufficiently controls and restricts the negative charging property of silica particles.

SUMMARY OF THE INVENTION

An object of the present invention is to provide a toner that solves the problems described above.

An object of the present invention is to provide a toner having a release agent, which is excellent in developing property, transferring property, and fixing property, hardly affected by its surroundings, and has good endurance by maximizing the potential of the toner.

Another object of the present invention is to provide a toner allowing formation of a clear image without any fogging, which has a high image density, excellent fine-line reproducibility, excellent tone reproduction of a highlight portion, and excellent endurance stability.

Another object of the present invention is to provide a toner having excellent fluidity, resolution, and transferring property.

Another object of the present invention is to provide a toner with which a stable image without any image defect can be obtained over a long period of time by abrading and eliminating adherents on the surface of a photoconductor, which are generated owing to long term use of the toner, or preventing the generation of the adherents.

Further another object of the present invention is to provide a toner having stable triboelectric charging property, which is hardly affected by surrounding conditions such as temperature and humidity.

Another object of the present invention is to provide a color toner suitable for forming a full-color image or a multiple-color image.

Another object of the present invention is to provide a color toner having good transparency on an overhead transparency (OHP) film, excellent low-temperature fixing property, and excellent high-temperature offset resistance.

Another object of the present invention is to provide a color toner having excellent storage stability, thermostability, and anti-blocking property.

The present invention relates to a toner comprising toner particles containing at least a resin, a colorant and a release agent, and silica particles, wherein:

the toner has a peak temperature of maximum endothermic peak in the range of 60 to 100° C. in a temperature ranging from 30 to 200° C. of an endothermic curve of differential scanning calorimetry (DSC) measurement;

the silica particles contain a titanium element; and the silica particles satisfy the following expressions.

$$0.7 \leqq (Ia_1/Ib_1) \leqq 2.0; \text{ and}$$

$$0.7 \leqq (Ia_2/Ib_2) \leqq 2.0$$

where $Ia_1$ represents a maximum intensity in the case of 2θ=25.3 deg, $Ib_1$ represents a mean intensity in the cases of 2θ=25.3 deg+2.0 deg. and of 2θ=25.3 deg.−2.0 deg., $Ia_2$ represents a maximum intensity in the case of 2θ=27.5 deg and $Ib_2$ represents a mean intensity in the cases of 2θ=27.5. deg+2.0 deg. and of 2θ=27.5 deg.−2.0 deg.

The inventors of the present invention have made extensive studies in order to obtain a toner having excellent low-temperature fixing property, color mixing property, and high-temperature offset resistance while attaining excellent developing property, transferring property, fixing property, and endurance under all kinds of environmental conditions; and long term storage stability under high-temperature conditions, even if a fixing means is used in which oil for preventing a high-temperature offset is not used or is somewhat used. As a result, the inventors of the present invention have finally found that a toner comprising toner particles containing at least a binder resin, a colorant and a release agent, and silica particles containing a titanium compound is extremely effective.

DETAILED DESCRIPTION OF THE PREFERRED EMBODIMENTS

In the X-ray diffraction on silica particles containing titanium elements according to the present invention, the ratio (Ia/Ib) of the maximum intensity Ia in the cases of 2θ=25.3 deg. or of 2θ=27.5 deg. to the mean intensity Ib, which is the mean value in the cases of 2θ+2.0 deg. and of 2θ−2.0 deg., is physical property value related to the crystalline form of titanium oxide in the silica particles.

More specifically, the silica particles in the present invention are silica particles containing a titanium compound (hereinafter, referred to as "titanium compound-containing silica particles"), which contains a titanium element, and in X-ray diffraction thereof, the ratio ($Ia_1/Ib_1$) of the maximum intensity $Ia_1$ at 2θ=25.3 deg. to the mean intensity $Ib_1$ at 2θ+2.0 deg. and 2θ−2.0 deg. is $0.7 \leqq Ia_1/Ib_1 \leqq 2.0$ and the ratio ($Ia_2/Ib_2$) of the maximum intensity $Ia_2$ at 2θ=27.5 deg. to the mean intensity $Ib_2$ at 2θ+2.0 deg. and 2θ−2.0 deg. is $0.7 \leqq Ia_2/Ib_2 \leqq 2.0$.

Meeting the relational expressions described above means that the titanium compound in the titanium compound-containing silica particles does not have crystallinity.

In the X-ray diffraction, it is generally known in the art that titanium oxide has several peaks. For instance, there is a large characteristic peak around 2θ=25.3 when the crystal system of titanium oxide is of an anatase type, and also there is a large characteristic peak around 2θ=27.5 when the crystal system is of a rutile type.

In the X-ray diffraction, amorphous silica has no peak and the intensity thereof tends to moderately increase from around 2θ=10 deg. to around 2θ=21 deg. and moderately decrease from around 2θ=22 deg. to 2θ=40 deg.

That is, in the X-ray diffraction, the titanium compound-containing silica particles in the present invention, which satisfy the relational expressions described above, are clearly defined such that the titanium compound thereof does not have any crystalline form specific to titanium oxide.

The inventors of the present invention have made extensive studies with respect to the effects of silica particles on the charging property and transferring property of a toner having excellent low-temperature fixing property and oil-less fixing property. Thus, the inventors of the present invention have found out that the toner can be provided with more ideal characteristics by controlling the charging property of a silica particle known as a material showing strong negative charging property to within the range of weak negative charging property to weak positive charging property. On this occasion, the inventors of the present invention have found a profound effect caused by blending a titanium compound, which is a material showing weak positive charging property, in the silica particle. Concretely, the inventors of the present invention have found that the titanium compound is capable of controlling the charging property of silica particles without causing any adverse effect characteristic by titanium compound by making the titanium compound into one having no crystal system.

When the titanium compound in silica particles has the crystallinity of titanium oxide, the titanium compound significantly exerts its individual characteristics and causes an increase in its positive charging property. As a result, the adhesion between the titanium compound exposed on the surface and a surface treating agent of silica particles decreases to make the control on the particle distribution difficult, so that the characteristics of the toner can be extensively adversely affected. Therefore, it is not preferable that the titanium compound in silica particles has the crystallinity of titanium oxide.

A raw material and method for producing the titanium compound-containing silica particles according to the present invention are not specifically limited, but one of the production examples will be described below.

The titanium compound-containing silica particles to be used in the present invention can be obtained by heating and sintering a mixture of a halogen-free siloxane and a volatile titanium compound in a gaseous phase.

Examples of the siloxane include a straight-chain organosiloxane, a cylic organosiloxane, and a mixture thereof. Among them, those containing no halogen are preferred.

Examples of the above-described organosiloxane include hexamethyldisiloxane, octamethyltrisiloxane, octamethylcyclotetrasiloxane, and decamethylcyclopentasiloxane. Those siloxanes do not contain halogens such as chlorine, and are preferably obtained through purification. Those siloxanes may be used solely or in combination of two or more kinds thereof.

The volatile titanium compound is not specifically limited. Any volatile titanium compound such as a chloride, alkoxide, or acetylacetonate of titanium may be used as far as the volatile titanium compound is volatile and thermally decomposable or hydrolyzable in a gaseous phase. Those volatile titanium compounds may be used solely or in combination of two or more kinds thereof.

Specific examples of the volatile titanium compounds to be used in the present invention include titanium compounds with volatility such as: titanium alkoxides such as titanium tetramethoxide, titanium tetraethoxide, titanium tetrapropoxide, titanium tetrabutoxide, and diethoxytitanium oxide; tetrahalogenated titaniums such as titanium tetrachloride and titanium tetrabromide; and halogenated titanium alkoxides such as trihalogenated monoalkoxy titanium, dihalogenated dialkoxy titanium, and monohalogenated trialkoxy titanium.

A mixture of the siloxane and the volatile titanium compound is provided as a liquified form and is introduced into a burner. Then, the liquified mixture is atomized from a nozzle equipped on a tip of the burner to ignite the mixture. Alternatively, the mixture of the siloxane and the volatile titanium compound may be heated and then the steam thereof may be introduced into the burner to ignite the steam.

In the present invention, the titanium compound-containing silica particles thus obtained are preferably used because of the following reasons. That is, in such silica particles, the titanium compound is uniformly dispersed. Thus, the silica particles have good charging property and excellent uniform reactivity with a surface treating agent.

A silica particles containing titanium compound can be also obtained by sintering a mixture of a silicon-halogenated compound and a titanium-halogenated compound at high temperatures in a gaseous phase. However, in view of the characteristics of raw materials, the titanium compound-containing silica particles like those shown in the present invention, which do not exhibit crystallinity, cannot be obtained. A large amount of halogenated compounds are used as a starting material, resulting in that the generated silica particles contain halogen as impurities. The halogen impurities will cause substantially undesirable effects on the charging property of toner, and in particular, significantly on toner containing a release agent, resulting in troubles including toner-scattering and fogging under high temperature and humidity conditions. Therefore, in the present invention, it is not preferable to use a large amount of halogenated compounds as a starting material.

Furthermore, the silica particles according to the present invention can be also obtained by mixing silica fine particles with amorphous titanium oxide fine particles and then sintering the mixture at a low temperature of approximately 800° C. In this case, however, it is difficult to disperse the mixture uniformly because both the silica fine particles and the amorphous titanium oxide fine particles are used as raw materials. Thus, the charge amount distribution tends to broaden.

Furthermore, the crystal growth of the amorphous titanium oxide fine particles progresses remarkably when the sintering temperature is higher than 800° C. Thus, titanium compound-containing silica particles showing no crystallinity similar to those in the present invention cannot be obtained.

The content of the titanium compound in the titanium compound-containing silica particles is preferably 0.1 to 20 parts by mass (with respect to 100 parts by mass of titanium compound-containing silica particles). It is not preferable that the content of the titanium compound exceed 20 parts by mass because of the following reason. The negative properties of silica particles decrease extremely when the content thereof exceeds 20 parts by mass, so that the charge amount distribution of toner will broaden and an adequate charge amount will be hardly retained. It is also not preferable that the content of the titanium compound be less than 0.1 parts by mass because of the following reason. The negative properties of silica particles appear notably when the content thereof is less than 0.1 parts by mass, so that the charge amount of toner under low-humidity conditions will increase extremely.

Examples of surface treating agents for the titanium compound-containing silica particles to be used in the present invention include: coupling agents such as silane coupling agents, titanate coupling agents, aluminum coupling agents, and zircoaluminate coupling agents; a silicone oil; and a silicone varnish.

For example, there may be used: alkylalkoxysilanes such as dimethyldimethoxysilane, trimethylethoxysilane, and butyltrimethoxysilane; and silane coupling agents such as dimethyldichlorosilane, trimethylchlorosilane, allyldimethylchlorosilane, hexamethyldisilazane, allylphenyldichlorosilane, benzyldimethylchlorosilane, vinyltriethoxysilane, γ-methacryloxypropyltrimethoxysilane, vinyltriacetoxysilane, divinylchlorosilane, and dimethylvinylchlorosilane.

It is preferable to treat the particles with a silazane compound alone or with a combination of a silazane compound and silicone oil, more preferably with a combination of hexamethyldisilazane and dimethyl silicone oil as a surface treating agent for the titanium compound-containing silica particles in the present invention in that good charging property and transferring property can be obtained.

For making maximal use of the characteristics of the surface treating agent while preventing the silica particles from agglutinating, the addition amount of the surface treating agent is preferably 1 to 30 parts by mass, more preferably 3 to 20 parts by mass with respect to 100 parts by mass of titanium compound-containing silica particles.

For performing the surface treating on the titanium compound containing-silica particles in the present invention, any of methods including a wet method and a dry method may be used, but the present invention is not specifically limited to use those methods.

It is preferable that the titanium compound-containing silica particles according to the present invention have a primary average particle diameter of 10 to 400 nm.

A primary average particle diameter of the silica particles is preferably in the range of 1 to 400 nm in terms of providing the toner with fluidity and abrasive property. If the primary average particle diameter is less than 1 nm, the silica particles tend to be embedded in the surface of a toner particle. Thus, the toner will deteriorate at an early stage, the endurance of the toner will tend to decrease and the abrasive property thereof will tend to get low.

The fluidity of toner decreases, therefore the charge thereof tends to become uneven when the primary average particle diameter exceeds 400 nm. As a result, the quality of an image deteriorates, and also the toner tends to be scattered and the fogging tends to occur. Furthermore, the surface of a photoconductor is vulnerable to be greatly scarred and image defects tend to be caused. In addition, a cleaning member such as a cleaning blade tends to be deformed or damaged.

For abrading the surface of the photoconductor and eliminating adherents on the surface of the photoconductor, the toner is temporary retained in a press-bonding portion between the surface of the photoconductor and the cleaning member such as a cleaning blade when the toner is cleaned from the surface of the photoconductor. The titanium compound-containing silica particles on the surface of toner particles being retained carry out functions of abrading the surface of the photoconductor and eliminating the adherents thereon. However, it is preferable that the titanium compound-containing silica particles be dispersed almost like primary particles free of agglomerate and uniformly placed on the surface of the toner particles without being embedded therein. For providing the titanium compound-containing silica particles with appropriate abrasive property, the primary average particle diameter thereof is in the range of 1 to 400 nm. The primary particle diameter within such a range is very effective when a predetermined intensity ratio in the X-ray diffraction of the titanium compound-containing silica particles shows the level in the present invention.

The silica particles having the primary average particle diameter of above range can be obtained by controlling reaction temperature of flame hydrolysis, sintering temperature of raw materials mixture, and time thereof in the preparation process.

The BET of the titanium compound-containing silica particles according to the present invention is preferably in the range of 5 to 300 $m^2/g$. The BET specific surface area of the titanium compound-containing silica particles of less than 5 $m^2/g$ indicates that the particles have large particle diameters and that agglomerates or coarse particles can be present. Thus, problems including a decrease in fluidity of toner, scars on the surface of the photoconductor, and deformation or damage of a cleaning member such as a cleaning blade, tend to occur. Furthermore, when the particle diameter of titanium compound-containing silica particles is larger than the above range, the silica particles tend to be released from toner particles. Thus, a large amount of free titanium compound-containing silica particles may remain in a developing device or adhere on various devices in the body of an image-forming apparatus to cause adverse effects on the devices. Therefore, it is not preferable that the particle diameter of titanium compound-containing silica particles be larger than the above range.

The water absorption to the titanium compound-containing silica particles increases when the BET specific surface area of the titanium compound-containing silica particles is larger than 300 $m^2/g$. In this case, therefore, the charging property of the toner may be adversely affected. In particular, under high humidity conditions, the triboelectric charging amount of the toner decreases and then toner scattering, fogging, and image degradation tend to be caused.

The BET of the silica particles of above range can be obtained by controlling reaction temperature of flame hydrolysis, sintering temperature of raw materials mixture, and time thereof in the preparation process. It can also be adjusted by changing surface-treating condition of the silica particles.

The addition amount of the titanium compound-containing silica particles according to the present invention is preferably 0.1 to 5 parts by mass with respect to 100 parts by mass of toner particles. If the addition amount of the silica particles is less than 0.1 parts by mass, the effects of improving the charging property and transferring property tend to be small. In addition, if the addition amount of the silica particles exceeds 5 parts by mass, the fluidity of toner decreases extensively, so that uniform charging can be prevented.

The toner of the present invention can include one or more kinds of inorganic fine particles in addition to the titanium compound-containing silica particles if required. The inorganic fine particles that can be used here are those known in the art, including: fine particles of metal oxides such as silica fine particles, alumina fine particles, titanium oxide fine particles, zirconium oxide fine particles, magnesium oxide fine particles, and zinc oxide; nitrides such as boron nitride fine particles, aluminum nitride fine particles, and carbon nitride fine particles; calcium titanate; strontium titanate; barium titanate; and magnesium titanate. In particular, inorganic fine particles having a primary average particle diameter of 1 to 200 nm are preferably used. In addition, for providing the particles with desired characteristics, it is preferable to treat the surface of the particles with a surface treating agent. At this time, the surface treating agent may be one of those known in the art as described above.

A binder resin to be used for toner particles may be one of various material resins known as toner binder resins in the art.

Examples of the binder resin include: styrene copolymers such as polystyrene, a styrene/butadiene copolymer, and a styrene/acrylic copolymer; ethylene copolymers such as polyethylene, an ethylene/vinyl acetate copolymer, and an ethylene/vinyl alcohol copolymer; and resins such as a phenolic resin, an epoxy resin, an acrylic phthalate resin, a polyamide resin, a polyester resin, and a maleic acid resin. Those resins may be used solely or in combination of two or more kinds.

Among those resins, it is preferable to use one having higher negative charging property, compared with others. That is, (a) a polyester resin, (b) a hybrid resin including a polyester resin unit and a vinyl copolymer unit, or (c) a mixture thereof is preferably used. Using the hybrid resin enhances the effects in the present invention. In particular, in combination with a release agent, those resins allow the release agent to function effectively at the time of fixation. Thus, each of those resins is excellent in fixing property and also good in color mixing property, thermostability, and anti-blocking property, and therefore is suited for color toner. However, their negative charging abilities tend to become strong to cause excessive charging. However, such a disadvantage can be improved by using silica particles containing titanium used for the present invention, resulting in obtaining an excellent toner. Here, the phrase "the binder resin of the toner is a polyester resin" means that the binder resin is mainly composed of a polyester resin.

The toner of the present invention contains one or more release agents.

The release agents to be used in the present invention may be those known in the art. Among them, in particular, preferable release agents to be used in the present invention include aliphatic hydrocarbon release agents. Such aliphatic hydrocarbon release agents include: a low-molecular weight alkylene polymer obtained by radical polymerization of alkylene under high pressures or polymerization thereof with a Ziegler-Natta catalyst under low pressures; an alkylene polymer obtained by thermally decomposing a high-molecular weight alkylene polymer; and a synthetic hydrocarbon release agent, which is obtained from a residue on distillation of a hydrocarbon obtained by the AG method from a synthetic gas containing carbon monoxide and hydrogen or which is obtained through hydrogenation of the synthetic gas. Furthermore, more preferable are release agents obtained by fractionating a hydrocarbon release agent with the use of a press sweating process, a solvent method, vacuum distillation, or a fractional crystallization method. The hydrocarbon as a ground material is preferably one selected from: a hydrocarbon prepared by reacting carbon monoxide and hydrogen using one of metal oxide catalysts (most of them are multi-component systems each containing two or more components) (e.g., a hydrocarbon synthesized by using a synthol process, or a hydrocal process using a fluid catalyst bed); a hydrocarbon having up to several hundreds of carbon atoms, obtained by the AG method using an identified catalyst bed in which a large amount of release agent-like hydrocarbons can be obtained; and a hydrocarbon prepared by polymerizing alkylene such as ethylene using a Ziegler-Natta catalyst because the hydrocarbons are long saturated straight-chain hydrocarbons with a few small branches. In particular, the release agent prepared by the process without using the polymerization of alkylene is preferable because of its molecular weight distribution.

The molecular weight distribution of the release agent has a main peak preferably in a molecular weight region ranging from 400 to 2,400, more preferably at a molecular weight region ranging from 430 to 2,000. Such a molecular weight distribution allows the toner to have preferable thermal characteristics.

For allowing the toner to act more preferably at the time of fixation, a melting point of the release agent is preferably 60 to 100° C., more preferably 65 to 90° C. Furthermore, the endothermic peak temperature of the toner of the present invention means a temperature that shows the maximum value by which an endothermic peak of the main peak is obtained on an endothermic curve in the differential scanning calorimetry (DSC) analysis on the toner containing the release agent. The endothermic peak means a physical property value originated from the melting point of the release agent.

The amount of the release agent to be used is 0.1 to 20 parts by mass, preferably 0.5 to 10 parts by mass with respect to 1.00 parts by mass of the binder resin.

A method for adding the release agent is not specifically limited. In general, the release agent may be added to a toner by a method including the steps of: dissolving a resin in a solvent; elevating the temperature of the resin solution; and adding the release agent and mixing the resin solution under stirring, or by a method in which the release agent is mixed with the resin at the time of kneading.

In the present invention, dyes and/or pigments known in the art can be used as colorants in the present invention.

Examples of a magenta toner coloring pigment include: C.I Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 155, 163, 202, 206, 207, and 209; C.I. Pigment Violet 19; and C.I Vat Red 1, 2, 10, 13, 15, 23, 29, and 35.

The pigment may be used solely. Preferably, the pigment may be used in combination with a dye to improve its definition in terms of the image quality of a full-color image.

Examples of a magenta toner dye include: oil-soluble dyes such as C.I. Solvent Red 1, 3, 8, 23, 24, 25, 27, 30, 49, 81, 82, 83, 84, 100, 109, and 121, C.I. Disperse Red 9, C.I. Solvent Violet 8, 13, 14, 21, and 27, and C.I Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, and 40, and C.I. Basic Violet 1, 3, 7, 10, 14, 15, 21, 25, 26, 27 and 28.

Examples of the cyan toner coloring pigment include: C.I. Pigment Blue 2, 3, 15, 16, and 17; C.I. Vat Blue 6; C.I. Acid Blue 45; and copper phthalocyanine pigments each having a structure of phthalocyanine substituted with 1 to 5 methyl phthalimide groups in the construction as shown in the following formula (1).

[formula (1)]

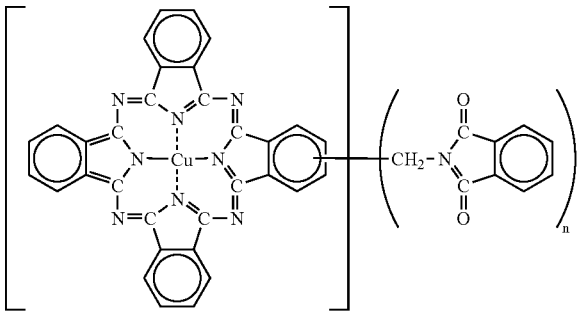

(wherein n denotes an integer of 1 to 5).

Examples of a yellow toner coloring pigment include: C.I. Pigment Yellow 1, 2, 3, 4, 5, 6, 7, 10, 11, 12, 13, 14, 15, 16, 17, 23, 65, 73, 74, 83, 97, 155, and 180; and C.I. Vat Yellow 1, 3, and 20.

Dyes such as C.I. Direct Green 6, C.I. Basic Green 4, C.I. Basic Green 6, and C.I. Solvent Yellow 162 may also be used.

As a black colorant to be used in the present invention, carbon black, a magnetic body, or a black colorant obtained by mixing colors of yellow, magenta, and cyan colorants can be used.

The used amount of colorant is preferably 0.1 to 15 parts by mass, more preferably 0.5 to 12 parts by mass, most preferably 2 to 10 parts by mass with respect to 100 parts by mass of the binder resin.

As a method for producing the toner particles to be used in the present invention, there is applied: a method comprising the steps of kneading components well with a heat kneading machine such as a heat roller, a kneader, or an extruder, mechanically pulverizing the kneaded components, and classifying the pulverized powders to obtain toner particles; a method in which a material such as a colorant is dispersed in a binder resin solution, and the dispersion is spray-dried to obtain toner particles; a method in which a predetermined material is mixed in a polymerizable monomer to be provided for constituting a binder resin to obtain a monomer composition, and an emulsified suspension of this composition is polymerized to obtain toner particles; or the like.

In the present invention, the toner can contain an organometallic compound. Preferable examples of the organometallic compound to be used in the present invention include compounds prepared by mixing aromatic carboxylic acids and metals of divalent or more.

Examples of the aromatic carboxylic acid are shown in the following three formulas (2) to (4):

[formula (2)]

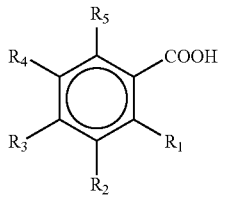

[formula (3)]

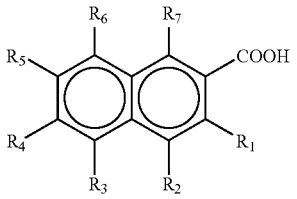

[formula (4)]

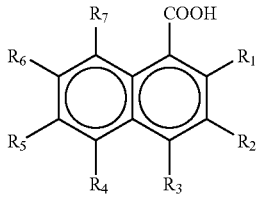

(wherein $R_1$ to $R_7$ represent the same or different groups, and represent a hydrogen atom, an alkyl group having 1 to 12 carbon atoms, an alkenyl group having 2 to 12 carbon atoms, —OH, —$NH_2$, —$NH(CH_3)$, —$N(CH_3)_2$, —$OCH_3$, —$O(C_2H_5)$, —COOH, or —$CONH_2$).

A preferable $R_1$ includes a hydroxyl group, an amino group, and a methoxy group. Among them, a hydroxyl group is preferable. A particularly preferable aromatic carboxylic acid includes a dialkyl salicylate such as di-tert-butyl salicylate.

Preferable metals that form the organometallic compounds are divalent or more metallic atoms. Examples of divalent metals include $Mg^{2+}$, $Ca^{2+}$, $Sr^{2+}$, $Pb^{2+}$, $Fe^{2+}$, $Co^{2+}$, $Ni^{2+}$, $Zn^{2+}$, and $Cu^{2+}$. Among divalent metals, $Zn^{2+}$ $Ca^{2+}$, $Mg^{2+}$, and $Sr^{2+}$ are preferable. Examples of metals of trivalent or more include $Al^{3+}$, $Cr^{3+}$, $Fe^{3+}$, and $Ni^{3+}$. Among them, $Al^{3+}$, $Fe^{3+}$, $Cr^{3+}$, and $Zn^{2+}$ are preferable, and $Al^{3+}$ is particularly preferable.

In the present invention, the organometallic compounds are preferably aluminum compounds of di-tert-butyl salicylate and zinc compounds of di-tert-butyl salicylate.

A metal compound of an aromatic carboxylic acid may be synthesized, for example, by dissolving an aromatic carboxylic acid in aqueous sodium hydroxide, dropping an aqueous solution containing a metal atom of divalent or more into the aqueous sodium hydroxide, stirring the mixture under heat, adjusting the pH of the resulting aqueous solution, cooling the solution to room temperature, and filtrating and washing the solution with water. However, the present invention is not limited to such a method.

The amount of the organometallic compound to be used is preferably 0.1 to 10 parts by mass, more preferably 0.2 to 5 parts by mass with respect to 100 parts by mass of the binder resin in terms of adjusting the viscoelasticity property and frictional charging property of the toner.

For further stabilizing the charging property of the toner of the present invention, compounds other than the above organometallic compounds may be used as charge controlling agents if required. Examples of the charge controlling agents may include nigrosine and imidazole compounds. The amount of the charge controlling agent to be used is 0.1 to 10 parts by mass, preferably 0.1 to 7 parts by mass with respect to 100 parts by mass of the binder resin.

In the present invention, when the toner is provided as one having nagative charging property, organometallic complexes, and chelate compounds are effective as charge controlling agents that shows negative charging property. Examples of the organometallic complexes include monoazo metal complexes, acetylacetone metal complexes, and metal complexes based on aromatic hydroxycarboxylic acids or aromatic dicarboxylic acids. Altanatively, aromatic hydroxycarboxylic acids, aromatic mono and polycarboxylic acids and metallic salts thereof, anhydrides, esters, or phenol derivatives such as bisphenol may be added.

In the present invention, when the toner is provided as one having positive charging property, it is preferable to add a charge controlling agent that shows positive charging property, such as a nigrosine or triphenylmethane compound, a rhodamine dye, or polyvinyl pyridine.

In the case of preparing a color toner, it is preferable to use a colorless or light-colored positive charge controlling agent that does not affect the color tone of the toner.

Next, the particle diameter of the toner to be used in the invention will be described.

As a result of extensive studies on image density, high-light reproducibility (halftone reproducibility) and fine-line reproducibility, a weight average particle diameter of toner to which the titanium compound-containing silica particles are externally added is preferably 3 to 9 μm.

If the weight average particle diameter of toner exceeds 9 μm, basically, there are few toner particles which can contribute to high image quality. Thus, the toner is hard to adhere accurately on the minute electrostatic image on the photoconductive drum, the high-light reproducibility thereof is scarce, and also the resolution thereof is low. Therefore, an excess amount of the toner is provided on the electrostatic image and thus an increase in toner consumption tends to occur.

On the other hand, if the weight average particle diameter of toner is less than 3 μm, the charge amount per unit mass of toner tends to increase, while the concentration of the toner decreases. In particular, a decrease in image density tends to be caused under low-temperature and low-humidity conditions. In particular, toner with a weight average particle diameter of less than 3 μm is not suitable to develop an image having a high image-area ratio, such as a graphic image.

If the weight average particle diameter of toner is less than 3 μm and the toner is used with carries as a two-component developer, the amount of the release agent near the surface of the toner increases extremely because the specific surface area of the toner increases. Thus, contact electrification of the toner with a carrier is not performed smoothly, so that the amount of toner which is not charged sufficiently can increase, resulting in remarkable scattering of the toner to a non-image area and fogging. For dealing with this phenomenon, the diameter of the carrier may be reduced to make the effective use of the specific surface area of the carrier. However, in the toner having a weight average particle diameter of less than 3 μm, toner particles tend to be automatically agglutinated. Thus, the toner cannot be uniformly mixed with the carrier within a short period of time. In addition, the endurance of toner to continuous supply tends to cause fogging.

The toner having the weight average particle diameter of above range was obtained by changing pulverizing condition of the particles with the air-jet system pulverizer or mechanical pulverizer, classifying condition of the fine particles and so on in preparation process of toner.

The toner of the present invention can be used in toner development of non-magnetic one-component system or non-magnetic two-component system.

When the toner of the present invention is used in the two-component developer, examples of carriers which can be used with the toner include surface-oxidized or unoxidized metals of iron, nickel, copper, zinc, cobalt, manganese, chromium, or rare earth; and alloys; oxides; and ferrite thereof.

In particular, a magnetic ferrite particle mainly constructed of three elements: manganese, magnesium, and iron (Mn—Mg—Fe) is preferable in terms of providing the toner with good charging property. It is particularly preferable to incorporate silicon element in the magnetic ferrite particles of three elements (Mn—Mg—Fe) at a concentration of 0.001 to 1 part by mass, more preferably 0.005 to 0.5 parts by mass with respect to 100 parts by mass of magnetic ferrite particles when a silicone resin is used as a coating resin for the magnetic ferrite particles.

The carriers are preferably coated with a resin. Preferably, the resin is a silicone resin. In particular, in the case where the toner of the present invention is used as color toner, a nitrogen-containing silicone resin, or a modified silicone resin generated by the reaction between a nitrogen-containing silane coupling agent and a silicone resin is preferable in terms of the addition of negative friction charges to the color toner, environmental stability, and prevention of the surface of the carrier from contamination.

The carriers have an average particle diameter of preferably 15 to 60 μm, more preferably 25 to 50 μm in relation to the weight average particle diameter of the toner.

For providing the toner with stable charging property in all environments, the surfaces of carriers is preferably coated with a resin.

As a method for coating the surfaces of carriers with a resin, any method conventionally known in the art can be used, for example a method including the steps of dissolving or suspending a resin in a solvent to apply and adhere the resin on carriers, or a method in which a resin is provided as powders and simply mixed with carriers.

Although fastening materials for the surface of the carriers differ between toners, for example, polytetrafluoroethylene, monochlorotrifluoroethylene polymers, polyvinylidene fluoride, silicone resins, polyester resins, styrene resins, acrylic resins, polyamide, polyvinyl butyral, and aminoacrylate resins may be appropriately used solely or in combination.

In particular, the silicone resin is preferable in terms of charge-imparting property, anti-toner spent property, and so on.

The amount of the coating resin to be used is preferably 0.1 to 30 parts by mass, more preferably 0.2 to 15 parts by mass with respect to 100 parts by mass of the carrier.

For preparing a two-component developer by mixing a developer with the toner of the present invention, a preferable result can be generally obtained when the toner is mixed with carriers such that the toner concentration in the developer is 2 to 15% by mass, preferably 3 to 13% by mass, more preferably 4 to 10% by mass. If the toner concentration is less than 2% by mass, the image density tends to decrease. In addition, a toner concentration of less than 2% of mass is not preferable because the developer tends to be deteriorated when the toner containing the release agent like the present invention is used. If the toner concentration exceeds 15% by mass, the charge amount distribution of the toner broadens to cause fogging or scattering of toner inside the apparatus. Therefore, a toner concentration above 15% by mass is not preferable.

Hereinafter, a method for measuring each physical property value to be used in the present invention will be described.

[Method for Measuring Ia and Ib of Silica Particles]

The X-ray diffraction measurement on silica particles in the present invention is carried out under the following conditions using CuKα radiation and using the silica particles as a sample.

Applied measuring machine: Full-automatic X-ray Diffraction Apparatus ("MXP18", manufactured by MAC Science K.K.)

X-ray tube: Cu
Tube Voltage: 50 KV
Tube Current: 300 mA
Scanning Method: 2θ/θ Scan
Scanning Speed: 4 deg./min
Sampling Interval: 0.020 deg.
Starting Angle (2θ): 3 deg.
Stopping Angle (2θ): 60 deg.
Divergence Slit: 0.5 deg.
Scattering Slit: 0.5 deg.
Receiving Slit: 0.3 mm.
A curved monochromator was used.

[Method for Measuring the Content of Titanium Compound in Silica Particles]

The method for measuring the content of titanium compound in silica is carried out by preparing an analytical curve using analytical-curve samples at first and then calculating the addition amount of titanium compound in a measuring sample from the analytical curve.

(1) Preparation of Analytical Curve

Using a coffee mill, analytical-curve samples are prepared by mixing titanium oxide fine powders with silica (X) at ratios of 0%, 0.5%, 1.0%, 3.0%, 5.0%, 10.0%, and 15.0% (% by mass), respectively.

Then, the above seven samples are pressed into shapes using a sample press-molding machine (the MAEKAWA Testing Machine, manufactured by MFG Co., Ltd.). From a 2θ table, aKα peak angle (a) of Ti element is determined. Subsequently, the analytical-curve samples are placed in the X-ray fluorescence device SYSTEM 3080 (manufactured by Rigaku Corporation), followed by depressurizing a sample chamber to vacuum. Under the following conditions, the X-ray intensity of each sample is obtained and then the analytic curve is formed. Note that the X-ray fluorescence analysis is conducted in accordance with the general principle of X-ray fluorescence analysis (JIS K0119).

(Measurement Conditions)

Measuring potential and voltage: 50 kV–50 mA,

2θ angle: a,

Crystalline plate: LiF, and

Measuring time: 60 seconds.

(2) Quantitative Determination of Titanium Compound in Silica Particles

Test samples are molded by the similar way as that of the above (1), followed by obtaining the X-ray intensity under the same measurement conditions. Then, the addition amount of a titanium compound in the silica particles is calculated using the analytical curve.

[Method for Measuring Primary Average Particle Diameter of Silica Particles and Inorganic Fine Particles]

The primary average particle diameters of silica particles and inorganic fine particles according to the present invention are calculated as follows. These particles are observed with a transmission electron microscope and then the longitudinal diameter of each of 100 particles is measured, followed by obtaining a number average particle diameter of the particles. The particle diameters of the respective toner particles are observed with a scanning electron microscope and then the longitudinal diameter of each of 100 particles is measured, followed by obtaining a number average particle diameter of the particles.

The measurement is performed on the particles having particle diameters of 0.5 nm or more at 40,000 to 60,000 magnifications.

[Method for Measuring BET Specific Surface Area of Silica Particles]

The measurement of BET specific surface area of silica particles and inorganic fine particles according to the present invention is carried out as follows.

The BET specific surface area of the particles is obtained by a BET multipoint method using a full-automatic gas absorption measuring device (Auto Soap 1, manufactured by Yuasa Ionics Co., Ltd.) and using nitrogen as an absorption gas.

As a pretreatment of a sample, degassing is performed at 50° C. for 10 hours.

[Measurement on Toner Using Differential Scanning Calorimeter (DSC)]

According to ASTM D3418-82, the measurement is carried out using a differential scanning calorimeter (DSC measuring apparatus) (DSC-7, manufactured by Perkin Elmer, Inc.).

2 to 10 mg, preferably 5 mg of test samples are weighted precisely. Then, the samples are placed in an aluminum pan and also an empty aluminum pan is used as a reference. Subsequently, these pans are heated at measuring temperatures ranging from 30 to 200° C. with a temperature rising rate of 10° C./min. under normal temperature and normal humidity. In this process of temperature rising, an endothermic peak of a main peak of the DSC curve at temperatures ranging from 30 to 200° C. can be obtained. Here, the term "endothermic peak temperature" means a temperature that indicates the maximum value in the temperature range.

[Method for Measuring Toner Diameter]

As a measuring device, the Coulter Counter TA-II or the Coulter Multisizer II (manufactured by Beckman Coulter, Inc.) is employed. As an electrolytic solution, an aqueous solution of about 1% NaCl is prepared using primary sodium chloride. For example, ISOTON-II (manufactured by Coulter Scientific Japan, Inc.) may be used. A measuring method includes the steps of: adding 0.1 to 5 ml of a surfactant (preferably alkylbenzene sulfonate) as a dispersant to 100 to 150 ml of the electrolytic solution; adding 2 to 20 mg of a test sample to the solution; dispersing the sample suspended in the electrolytic solution for about 1 to 3 minutes with an ultrasonic dispersing device; and measuring the volume and number of toner for every channel using 100 μm apertures as an aperture with the measuring device to calculate the volume distribution and number distribution of toner. Subsequently, a weight average particle diameter (D4) (the median of each channel is provided as a central value for every channel) of toner is calculated on the basis of the weight obtained from the volume distribution of toner particles.

13 Channels of 2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 m; and 32.00 to 40.30 μm are used as the channels.

EXAMPLES

Hereinafter, production examples and practical examples of the present invention will be described. However, the present invention is not only limited to these examples.

<Production of Titanium Compound-Containing Silica Particles>

(Production Example 1 of Titanium Compound-Containing Silica Particles)

92 parts by mass of hexamethyldisiloxane and 8 parts by mass of titanium tetrapropoxide were mixed sufficiently at room temperature. Then, the mixture was atomized so as to be in a state of fine liquid droplets and was then introduced into a burner together with oxygen, air, and propane, followed by being subjected to flame hydrolysis at a flame temperature of 2,300° C., resulting in untreated titanium compound-containing silica particles.

Subsequently, the titanium compound-containing silica particles were subjected to a surface treating. 100 parts by mass of the titanium compound-containing silica particles was placed in a stirrer, and then a mixture solution of 10 parts by mass of hexamethyldisilazane and 10 parts by mass of hexane was atomized to the particles while the particles were stirred, and then the whole was subjected to a stirring treatment. Subsequently, 5 parts by mass of dimethyl silicone oil and 10 parts by mass of hexane were atomized to the resultant product and the whole was subjected to a stirring treatment. After that, the resulting particles were heated up to 120° C. and were stirred. Subsequently, the solvent was dried, resulting in titanium compound-containing silica particles 1.

The presence of titanium compound in the silica particles was confirmed using a nondispersive X-ray diffraction analyzer (EDAX).

Prescriptions and properties of the titanium compound-containing silica particles were listed in Table 1 and Table 2, respectively.

(Production Example 2 of Titanium Compound-Containing Silica Particles)

Titanium compound-containing silica particles 2 were obtained by the same method as that of Production Example 1 of the titanium compound-containing silica particles, except that dimethyl silicone oil was not used and a reaction temperature was set of 2,500° C. ° C.

(Production Example 3 of Titanium Compound-Containing Silica Particles)

Titanium compound-containing silica particles 3 were obtained by the same method as that of Production Example 2 of the titanium compound-containing silica particles, except that 1.5 parts by mass of titanium tetraisopropoxide was used and 10 parts by mass of dimethyl silicone oil was added.

(Production Example 4 of Titanium Compound-Containing Silica Particles)

Titanium compound-containing silica particles 4 were obtained by the same method as that of Production Example 3 of the titanium compound-containing silica particles, except that 13 parts by mass of titanium tetraisopropoxide was used.

(Production Example 5 of Titanium Compound-Containing Silica Particles)

Titanium compound-containing silica particles 5 were obtained by the same method as that of Production Example 3 of the titanium compound-containing silica particles, except that 23 parts by mass of titanium tetraisopropoxide was used.

(Production Example 6 of Titanium Compound-Containing Silica Particles)

Titanium compound-containing silica particles 6 were obtained by the same method as that of Production Example 3 of the titanium compound-containing silica particles, except that 28 parts by mass of titanium tetraisopropoxide was used and the amount of propane to be supplied was controlled to set the reaction temperature of 2,000° C.

(Production Example 7 of Titanium Compound-Containing Silica Particles)

Titanium compound-containing silica particles 7 were obtained by the same method as that of Production Example 4 of the titanium compound-containing silica particles, except that the amount of propane to be supplied was controlled to set the reaction temperature of 4,200° C., 7 parts by mass of dimethyldichlorosilane was added instead of hexamethyldisilazane, and dimethyl silicone oil was not used.

(Production Example 8 of Titanium Compound-Containing Silica Particles)

Titanium compound-containing silica particles 8 were obtained by the same method as that of Production Example 7 of the titanium compound-containing silica particles, except that the amount of propane to be supplied was controlled to set the reaction temperature of 1,400° C., 20 parts by mass of dimethyldichlorosilane was added, and dimethyl silicone oil was not used.

(Production Example 9 of Titanium Compound-Containing Silica Particles)

Titanium compound-containing silica particles 9 were obtained by the same method as that of Production Example 4 of the titanium compound-containing silica particles, except that hexamethyldisiloxane and titanium tetrachloride were used as raw materials.

(Production Example 10 of Titanium Compound-Containing Silica Particles)

Titanium compound-containing silica particles 10 were obtained by the same method as that of Production Example 4 of the titanium compound-containing silica particles, except that silicon tetrachloride and titanium tetraisopropoxide were used as raw materials, the amount of propane to be supplied was controlled to conduct sintering at 1000° C., and dimethyl silicone oil was not used.

(Production Example 11 of Titanium Compound-Containing Silica Particles)

Titanium compound-containing silica particles 11 were obtained by the same method as that of Production Example 4 of the titanium compound-containing silica particles, except that silicon tetrachloride and titanium tetrachloride were used as raw materials, the amount of propane to be supplied was controlled to conduct sintering at 1000° C., and dimethyl silicone oil was not used.

(Production Example 12 of Titanium Compound-Containing Silica Particles)

90 parts by mass of silica sol having a BET specific surface area of 120 $m^2/g$ and 10 parts by mass of titania sol having a BET specific surface area of 200 $m^2/g$ were mixed sufficiently through a wet process, followed by dehydration and drying. Then, the resultant mixture was sintered at 300° C. for 3 hours to obtain a mixture oxide. Subsequently, a surface treating was subjected on the mixture oxide by the same method as that of Production Example 2 of titanium compound-containing silica particles to obtain titanium compound-containing silica particles 12.

(Production Example 13 of Titanium Compound-Containing Silica Particles)

Titanium compound-containing silica particles 13 were obtained by the same method as that of Production Example 12 of the titanium compound-containing silica particles, except that 90 parts by mass of amorphous silica having a BET specific surface area of 120 $m^2/g$ and 10 parts by mass of amorphous titanium having a BET specific surface area of 200 $m^2/g$ were used and sintering was conducted at 1000° C.

(Production Example 14 of Titanium Compound-Containing Silica Particles)

Titanium compound-containing silica particles 14 were obtained by the same method as that of Production Example 13 of the titanium compound-containing silica particles, except for using anatase-type titanium oxide having a BET specific surface area of 180 $m^2/g$.

(Production Example 15 of Titanium Compound-Containing Silica Particles)

Titanium compound-containing silica particles 15 were obtained by the same method as that of Production Example 14 of the titanium compound-containing silica particles, except that sintering was conducted at 300° C.

(Production Example 16 of Titanium Compound-Containing Silica Particles)

Titanium compound-containing silica particles 16 were obtained by the same method as that of Production Example 13 of the titanium compound-containing silica particles, except that rutile type titanium oxide having a BET specific surface area of 150 $m^2/g$ was used.

TABLE 1

Prescription of titanium compound-containing silica particles

| titanium compound-containing silica particles No. | Raw silica component | Raw titanium component | Surface treating agent 1 Kind | Surface treating agent 1 Addition amount (part by mass) | Surface treating agent 2 Kind | Surface treating agent 2 Addition amount (part by mass) |
|---|---|---|---|---|---|---|
| 1 | Hexamethyldisiloxane | Titanium tetraisopropoxide | HMDS | 10 | Dimethyl silicone oil | 5 |
| 2 | Hexamethyldisiloxane | Titanium tetraisopropoxide | HMDS | 10 | — | — |
| 3 | Hexamethyldisiloxane | Titanium tetraisopropoxide | HMDS | 10 | Dimethyl silicone oil | 10 |
| 4 | Hexamethyldisiloxane | Titanium tetraisopropoxide | HMDS | 10 | Dimethyl silicone oil | 10 |
| 5 | Hexamethyldisiloxane | Titanium tetraisopropoxide | HMDS | 10 | Dimethyl silicone oil | 10 |
| 6 | Hexamethyldisiloxane | Titanium tetraisopropoxide | HMDS | 10 | Dimethyl silicone oil | 10 |
| 7 | Hexamethyldisiloxane | Titanium tetraisopropoxide | Dimethyl-di-chlorosilane | 7 | — | — |
| 8 | Hexamethyldisiloxane | Titanium tetraisopropoxide | Dimethyl-di-chlorosilane | 20 | — | — |
| 9 | Hexamethyldisiloxane | Titanium tetrachloride | HMDS | 10 | Dimethyl silicone oil | 10 |
| 10 | Silicon tetrachloride | Titanium tetraisopropoxide | HMDS | 10 | — | — |
| 11 | Silicon tetrachloride | Titanium tetrachloride | HMDS | 10 | — | — |
| 12 | Silica sol | Titania sol | HMDS | 10 | — | — |
| 13 | Amorphous silica | Amorphous titanium | HMDS | 10 | — | — |
| 14 | Amorphous silica | Anatase titanium | HMDS | 10 | — | — |
| 15 | Amorphous silica | Anatase titanium | HMDS | 10 | — | — |
| 16 | Amorphous silica | Rutile titanium | HMDS | 10 | — | — |

TABLE 2

Properties of titanium compound-containing silica particles

| titanium compound-containing silica particles No. | X-ray diffraction data 2θ = 25.3 Ia/Ib | Ia cps | Ib cps | $I_{2\theta-2.0deg}$ cps | $I_{\theta+2.0deg}$ cps | 2θ = 27.5 Ia/Ib | Ia cps | Ib cps | $I_{2\theta-2.0deg}$ cps | $I_{\theta+2.0deg}$ cps | Content of titanium compound (part by mass) | Titanium compound-containing silica particle diameter (nm) | BET of titanium compound-containing silica particle ($m^2/g$) |
|---|---|---|---|---|---|---|---|---|---|---|---|---|---|
| 1 | 1.08 | 4300 | 4000 | 4800 | 3200 | 0.98 | 3100 | 3150 | 3900 | 2400 | 5 | 35 | 70 |
| 2 | 1.07 | 4300 | 4015 | 4850 | 3180 | 1.00 | 3150 | 3140 | 3910 | 2370 | 5 | 40 | 60 |
| 3 | 1.01 | 4100 | 4060 | 4870 | 3250 | 0.97 | 3080 | 3160 | 3930 | 2390 | 0.1 | 40 | 60 |
| 4 | 1.15 | 4600 | 3995 | 4770 | 3220 | 0.98 | 3100 | 3160 | 3900 | 2420 | 10 | 40 | 60 |
| 5 | 1.27 | 5130 | 4035 | 4810 | 3260 | 0.98 | 3090 | 3155 | 3910 | 2400 | 20 | 40 | 60 |
| 6 | 1.39 | 5530 | 3990 | 4830 | 3150 | 0.98 | 3120 | 3195 | 4000 | 2390 | 23 | 30 | 100 |
| 7 | 1.15 | 4600 | 4000 | 4790 | 3210 | 0.99 | 3090 | 3135 | 3900 | 2370 | 10 | 400 | 5 |
| 8 | 1.15 | 4600 | 3985 | 4770 | 3200 | 0.98 | 3100 | 3160 | 3890 | 2430 | 10 | 10 | 300 |
| 9 | 1.15 | 4600 | 4005 | 4820 | 3190 | 0.97 | 3100 | 3190 | 3970 | 2410 | 10 | 40 | 70 |
| 10 | 1.15 | 4600 | 4005 | 4810 | 3200 | 1.01 | 3170 | 3150 | 3900 | 2400 | 10 | 40 | 70 |
| 11 | 1.15 | 4600 | 4000 | 4780 | 3220 | 1.00 | 3190 | 3190 | 3930 | 2450 | 10 | 40 | 70 |
| 12 | 1.14 | 4600 | 4030 | 4830 | 3230 | 0.99 | 3100 | 3140 | 3880 | 2400 | 10 | 40 | 70 |
| 13 | 2.61 | 10350 | 3970 | 4750 | 3190 | 0.99 | 3090 | 3135 | 3900 | 2370 | 10 | 40 | 70 |
| 14 | 0.66 | 1043 | 1585 | 1910 | 1260 | 0.97 | 3080 | 3180 | 3920 | 2440 | 10 | 10 | 290 |
| 15 | 0.60 | 660 | 1065 | 1400 | 730 | 0.61 | 943 | 1550 | 1400 | 1700 | 10 | 7 | 330 |
| 16 | 0.97 | 3900 | 4020 | 4840 | 3200 | 3.61 | 11480 | 3180 | 3900 | 2460 | 10 | 40 | 70 |

<Production of External Additives Other than Titanium Compound-Containing Silica Particles>

(Production Example 1 of Hydrophobic Alumina Fine Particles)

In a stirrer, 100 parts by mass of amorphous alumina (BET specific surface area: 190 $m^2/g$) was added. Then, a mixture of 20 parts by mass of i-butyltrimethoxysilane and 20 parts by mass of hexane was atomized to the amorphous alumina while the amorphous alumina was stirred, and the whole was subjected to a stirring treatment. The resulting fine particles were heated up to 120° C. and were stirred, followed by drying the solvent to obtain hydrophobic alumina fine particles (a) (BET specific surface area: 130 $m^2/g$).

(Production Example 1 of Hydrophobic Titanium Oxide Fine Particles)

In a stirrer, 100 parts by mass of anatase type titanium oxide fine particles (BET specific surface area: 180 $m^2/g$) synthesized by using sulfuric acid were added. Then, a mixture of 20 parts by mass of i-butyltrimethoxysilane and 20 parts of hexane was atomized to the anatase type titanium oxide fine particles while the anatase type titanium oxide fine particles were stirred, and the whole was subjected to a stirring treatment. The resulting fine particles were heated up to 120° C. and were stirred, followed by drying the solvent dissolving the particles to obtain hydrophobic titanium oxide fine particles (b) (BET specific surface area: 120 $m^2/g$).

(Production Example 2 of Hydrophobic Titanium Oxide Fine Particles)

In a stirrer, 100 parts by mass of anatase type titanium oxide fine particles (BET specific surface area: 190 $m^2/g$) synthesized by using sulfuric acid were added. Then, a mixture of 10 parts by mass of hexamethyldisilazane and 10 parts by mass of hexane was atomized to the anatase type titanium oxide fine particles while the anatase type titanium oxide fine particles were stirred, and the whole was subjected to a stirring treatment. The resulting fine particles were heated up to 120° C. and were stirred, followed by drying the solvent dissolving the particles to obtain hydrophobic titanium oxide fine particles (c) (BET specific surface area: 75 $m^2/g$).

(Production Example 1 of Silica Fine Particles)

In a stirrer, 100 parts by mass of silica fine particles (BET specific surface area: 100 $m^2/g$) synthesized through a dry process was added. Then, a mixture of 10 parts by mass of hexamethyldisilazane and 10 parts by mass of hexane was atomized atomized to the silica fine particles while the silica fine particles were stirred, and the whole was subjected to a stirring treatment. The resulting fine particles were heated up to 120° C. and were stirred, followed by drying the solvent dissolving the particles to obtain silica fine particles (d) (BET specific surface area: 75 $m^2/g$)

(Production Example 1 of Positive Silica Fine Particles)

In a stirrer, 100 parts by mass of silica fine particles (BET specific surface area: 100 $m^2/g$) synthesized through a dry process was added. Then, a mixture of 10 parts by mass of γ-aminopropyltriethoxysilane and 10 parts by mass of hexane was atomized to the silica fine particles while the silica fine particles were stirred, and the whole was subjected to a stirring treatment. The resulting fine particles were heated up to 120° C. and were stirred, followed by drying the solvent dissolving the particles to obtain positive silica fine particles (e) (BET specific surface area: 75 $m^2/g$).

<Production of Binder Resin>

(Production Example 1 of Hybrid Resin)

As vinyl copolymers, 1.9 mol of styrene, 0.21 mol of 2-ethylhexylacrylate, 0.15 mol of fumaric acid, 0.03 mol of α-methyl styrene dimer, and 0.05 mol of dicumyl peroxide were placed in a drop funnel. In addition, 7.0 mol of polyoxypropylene (2.2)-2,2-bis (4-hydroxyphenyl)propane, 3.0 mol of polyoxyethylene (2.2)-2,2-bis(4-hydroxyphenyl) propane, 3.0 mol of succinic acid, 2.0 mol of anhydrous trimellitic acid, 5.0 mol of fumaric acid, and 0.2 g of dibutyltin oxide were placed in a four-neck flask (4 litters in volume) made of glass. Then, a thermometer, a stirring rod, a condenser, and a nitrogen-introduction pipe were mounted on the flask, followed by placing the flask in a mantle heater. Subsequently, the air in the flask was replaced with nitrogen gas, followed by gradually heating up while stirring. Then, the mixture was stirred at 145° C., while the vinyl resin monomer, a cross-linking agent, and a polymerization initiator were dropped from the drop funnel over 4 hours. After that, the flask was heated up to 200° C. to allow the reaction for 4 hours, resulting in a hybrid resin. The results of the molecular weight measurement with GPC are listed in Table 3.

(Production Example 1 of Polyester Resin)

3.6 mol of polyoxypropylene (2.2)-2,2-bis(4-hydroxyphenyl)propane, 1.6 mol of polyoxyethylene (2.2)-2,2-bis(4-hydroxyphenyl) propane, 1.7 mol of terephthalic acid, 1.1 mol of anhydrous trimellitic acid, 2.4 mol of fumaric acid, and 0.1 g of dibutyltin oxide were placed in a four-neck flask (4 litters in volume) made of glass. Then, a thermometer, a stirring rod, a condenser, and a nitrogen-introduction pipe were mounted on the flask, followed by placing the flask in a mantle heater. After that, the flask was heated up to 215° C. under nitrogen atmosphere to allow the mixture to react for 5 hours, thereby obtaining a polyester resin. The results of the molecular weight measurement with GPC are listed in Table 3.

(Production Example 1 of Vinyl Resin)

Placed in a four-neck flask (3 litters in volume) equipped with a thermometer, a stainless steel stirring rod, a flow-down system condenser, and a nitrogen introduction tube were 1,000 ml of a toluene solvent, and as vinyl copolymers, 2.4 mol of styrene, 0.26 mol of n-butyl acrylate, 0.09 mol of monobutyl malate, and 0.11 mol of di-t-butyl peroxide. Then, the flask was placed in a mantle heater to heat up the mixture at 120° C. under nitrogen atmosphere to react the mixture under reflux with toluene while stirring the mixture. Consequently, a vinyl resin was obtained. The results of molecular weight measurement with GPC are listed in Table 3.

TABLE 3

Results of molecular weight measurement (GPC)

| Resin type | Mw ($\times 10^3$) | Mn ($\times 10^3$) | Mp ($\times 10^3$) | Mw/Mn |
|---|---|---|---|---|
| Hybrid resin | 83.0 | 3.1 | 15.4 | 26.77 |
| Polyester resin | 25.7 | 3.2 | 6.4 | 8.03 |
| Vinyl resin | 19.0 | 2.7 | 9.1 | 7.04 |

<Release Agent>

Release agents used in the present invention are listed in Table 4.

(Wax (a))

Normal-paraffin wax: wax (a) (melting point: 74.3° C.), which was obtained by purifying hydrocarbon prepared by the AG method with a press-sweating process, was used.

(Wax (b))

Benzene, a long-chain alkyl carboxylic acid component, a long-chain alkyl alcohol component, and p-toluene sulfonic acid were dissolved and stirred, followed by subjecting the mixture to azeotropic distillation. Then, the product was sufficiently washed with sodium hydrogen carbonate and recrystallized by drying, followed by washing and purification. Consequently, the resulting ester wax: wax (b) (melting point: 72.7° C.) was used.

(Wax (c))

Normal-paraffin wax: wax (c) (melting point: 51.0° C.), which was obtained without sufficiently purifying hydrocarbon prepared by the AG method, was used.

(Wax (d))

Polyethylenewax: wax (d) (melting point: 95.7° C.), which was obtained by polymerization with a Ziegler-Natta catalyst under low pressure, was used.

(Wax (e))

Alcohol-denatured polyethylene wax: wax (e) having a high melting point (melting point: 108.9° C.) was used.

TABLE 4

| Kind of wax | Melting point | Kind of wax |
|---|---|---|
| Wax (a) | 74.3° C. | Purified normal-paraffin |
| Wax (b) | 72.7° C. | Ester wax |
| Wax (c) | 51.0° C. | Paraffin |
| Wax (d) | 95.7° C. | Polyethylene |
| Wax (e) | 108.9° C. | Alcohol-denatured PE |

Example 1

| | |
|---|---|
| Hybrid resin | 100 parts by mass |
| Phthalocyanine pigment (cyan colorant) | 4 parts by mass |
| Aluminum complex of di-tert-butyl salicylic acid (Negative charge controlling agent) | 3 parts by mass |
| Wax (a) | 4 parts by mass |

The above compounds were sufficiently premixed with a Henschel mixer and then fusion kneading was carried out with a twin-screw extrusion kneader. After cooling, the mixture was roughly pulverized into particles having a diameter of approximately 1 to 2 mm. Subsequently, the particles were further pulverized into fine particles with an air-jet system pulverizer. Then, the resulting fine particles were classified, to thereby obtain non-magnetic cyan toner particles having a weight-average particle diameter of 6.1 μm and negative triboelectrific charging property.

Next, 100 parts by mass of the cyan toner particles, 1.0 parts by mass of titanium compound-containing silica particles 1, and 0.5 parts by mass of hydrophobic alumina fine particles a as combined inorganic fine particles were mixed with a Henschel mixer, to thereby obtain non-magnetic cyan toner. The resulting cyan toner has a weight average particle diameter of 6.0 μm (the toner includes 21.5% by number of toner having a particle diameter of 4.0 μm or less, 48.1% by number of toner having a particle diameter of 5.04 μm or less, 6.3% by volume of toner having a particle diameter 8.0 μm or more, and 0.6% by volume of toner having a particle diameter 10.08 μm or more).

The cyan toner and carriers obtained by coating Mn—Mg ferrite particles with a silicone resin (the particle diameter of carrier: 45 μm, and the amount of coated resin: 0.6 parts by mass with respect to 100 parts by mass of carrier core particles) were mixed at a toner concentration of 6%, to thereby prepare a two-component developer. Then, an image was outputted from the color copier CLC-800 (manufactured by Canon, Inc., single color mode, 28 sheets/min. for A4 size). At this time, a modified fixing device free of an oil-applying mechanism was used as a fixing unit of the color copier. In this case, a photoconductive drum was one having an abraded surface with a sand paper #500 and a surface roughness Rz of 1.3 μm. Furthermore, a printing endurance test of 10,000 sheets as a mono-color mode was performed using an original copy having an image-area ratio of 25% under high-temperature and high-humidity conditions (35° C./90%) or using an original copy having an image-area ratio of 5% under normal-temperature and low-humidity conditions (23° C./5%) with the loading amount of toner per unit area being set to 0.6 mg/cm$^2$.

Consequently, favorable results were obtained. That is, the transition of image density was stable without depending on the environments, an image having high quality and stability was obtained without causing dropout of lines from the image, and a temperature range for fixation was wide.

Example 2

A printing endurance test was performed by the same method as that of Example 1, except that the titanium compound-containing silica particles 2 were used.

Example 3

A printing endurance test was performed by the same method as that of Example 1, except that the titanium compound-containing silica particles 3 were used and hydrophobic alumina fine particles (a) were not used.

Example 4

A printing endurance test was performed by the same method as that of Example 1, except that the titanium compound-containing silica particles 4 were used.

Example 5

A printing endurance test was performed by the same method as that of Example 1, except that the titanium compound-containing silica particles 5 were used.

Example 6

A printing endurance test was performed by the same method as that of Example 1, except that toner having the weight average particle diameter of 4.0 μm was used. The toner was obtained by the same method as that of Example 1 of the toner, except that pulverizing condition of the particles with the air-jet system pulverizer and classifying condition of the fine particles were changed.

Example 7

A printing endurance test was performed by the same method as that of Example 1, except that toner having the weight average particle diameter of 9.0 μm was used. The toner was obtained by the same method as that of Example 1 of the toner, except that pulverizing condition of the particles with the air-jet system pulverizer and classifying condition of the fine particles were changed.

Example 8

A printing endurance test was performed by the same method as that of Example 1, except that 6 parts by mass of C.I. Pigment Red 155 (a magenta colorant) was used in place of a phthalocyanine pigment and the titanium compound-containing silica particles 6 were used.

Example 9

A printing endurance test was performed by the same method as that of Example 1, except that 8 parts by mass of C.I. Pigment Yellow 74 (a yellow colorant) was used in place of a phthalocyanine pigment and the titanium compound-containing silica particles 7 were used.

Example 10

A printing endurance test was performed by the same method as that of Example 1, except that carbon black was used in place of phthalocyanine pigment and the titanium compound-containing silica particles 8 were used. Next, the output of a full-color image was investigated using four color toners used in Example 1 and Examples 8 to 10. Consequently, an image having excellent color mixing property and showing high fineness and high quality was obtained.

Example 11

A printing endurance test was performed by the same method as that of Example 1, except that the polyester resin was used in place of the hybrid resin, the titanium compound-containing silica particles 9 were used, and the hydrophobic titanium oxide fine particles b were used in place of the hydrophobic alumina fine particles a.

Example 12

A printing endurance test was performed by the same method as that of Example 1, except that 80 parts by mass of the polyester resin was used in place of the hybrid resin, 20 parts by mass of vinyl resin was used, and the titanium compound-containing silica particles 10 were used.

Example 13

A printing endurance test was performed by the same method as that of Example 1, except that the vinyl resin was used in place of the hybrid resin and the titanium compound-containing silica particles 11 were used.

Example 14

A printing endurance test was performed by the same method as that of Example 1, except that the wax (b) was used in place of the wax (a) and the titanium compound-containing silica particles 12 were used.

Example 15

A printing endurance test was performed by the same method as that of Example 1, except that the wax (d) was used in place of the wax (a) and the titanium compound-containing silica particles 12 were used.

Comparative Example 1

A printing endurance test was performed by the same method as that of Example 1, except that the titanium compound-containing silica particles 13 were used.

Comparative Example 2

A printing endurance test was performed by the same method as that of Example 1, except that the titanium compound-containing silica particles 14 were used.

Comparative Example 3

A printing endurance test was performed by the same method as that of Example 1, except that the titanium compound-containing silica particles 15 were used.

Comparative Example 4

A printing endurance test was performed by the same method as that of Example 1, except that the titanium compound-containing silica particles 16 were used.

Comparative Example 5

A printing endurance test was performed by the same method as that of Example 1, except that 0.8 parts by mass of the silica particles (d) and 0.2 parts by mass of the titanium oxide fine particles (c) were used in place of the titanium compound-containing silica particles 1.

Comparative Example 6

A printing endurance test was performed by the same method as that of Example 1, except that positive silica fine particles (e) were used in place of the titanium compound-containing silica particles 1.

Comparative Example 7

A printing endurance test was performed by the same method as that of Example 1, except that the wax (e) was used in place of the wax (a).

Comparative Example 8

A printing endurance test was performed by the same method as that of Example 1, except that the wax (c) was used in place of the wax (a).

Prescription of toners used in Examples and Comparative Examples and the results thereof are listed in Table 5 and Table 6.

TABLE 5

Prescription of Toners used in Examples and Comparative Examples

| | Titanium compound-containing silica particles | Combined inorganic fine particles | Toner | Resin | Wax |
|---|---|---|---|---|---|
| Example 1 | 1 | a | Cyan | Hybrid | a: Paraffin |
| Example 2 | 2 | a | Cyan | Hybrid | a: Paraffin |
| Example 3 | 3 | — | Cyan | Hybrid | a: Paraffin |
| Example 4 | 4 | a | Cyan | Hybrid | a: Paraffin |
| Example 5 | 5 | a | Cyan | Hybrid | a: Paraffin |
| Example 6 | 1 | a | Cyan | Hybrid | a: Paraffin |
| Example 7 | 1 | a | Cyan | Hybrid | a: Paraffin |
| Example 8 | 6 | a | Magenta | Hybrid | a: Paraffin |
| Example 9 | 7 | a | Yellow | Hybrid | a: Paraffin |
| Example 10 | 8 | a | Black | Hybrid | a: Paraffin |
| Example 11 | 9 | b | Cyan | Polyester | a: Paraffin |
| Example 12 | 10 | a | Cyan | Polyester/Vinyl | a: Paraffin |
| Example 13 | 11 | a | Cyan | Vinyl | a: Paraffin |
| Example 14 | 12 | a | Cyan | Hybrid | b: Ester |
| Example 15 | 12 | a | Cyan | Hybrid | d: Polyethylene |
| Comparative Example 1 | 13 | a | Cyan | Hybrid | a: Paraffin |
| Comparative Example 2 | 14 | a | Cyan | Hybrid | a: Paraffin |
| Comparative Example 3 | 15 | a | Cyan | Hybrid | a: Paraffin |
| Comparative Example 4 | 16 | a | Cyan | Hybrid | a: Paraffin |
| Comparative Example 5 | c + d | a | Cyan | Hybrid | a: Paraffin |
| Comparative Example 6 | e | a | Cyan | Hybrid | a: Paraffin |
| Comparative Example 7 | 1 | a | Cyan | Hybrid | e: Denatured PE |
| Comparative Example 8 | 1 | a | Cyan | Hybrid | c: Paraffin |

TABLE 6

Results of Examples and Comparative Examples

| | Endothermic | Toner | Fixation temperature range (°C.) | | Under high-temperature and high-humidity condition | | | | |
|---|---|---|---|---|---|---|---|---|---|
| | curve Endothermic peak | particle diameter (μm) | Fixation-initiating temperature | Offset-initiating temperature | Macbeth image density | Fog-ging | Toner-scatter-ing | Dropout level | Surface condition of photoconductor |
| Example 1 | 68.1 | 6.0 | 115 | 230 | 1.79Stable transition | A | A | A | A |
| Example 2 | 68.1 | 6.0 | 115 | 230 | 1.77Stable transition | A | A | B | A |
| Example 3 | 68.1 | 6.0 | 115 | 230 | 1.76Stable transition | A | A | B | A |
| Example 4 | 68.0 | 6.0 | 115 | 230 | 1.75→1.79 | A | B | A | A |
| Example 5 | 68.0 | 6.0 | 115 | 230 | 1.72→1.80 | B | B | A | A |
| Example 6 | 68.1 | 4.0 | 115 | 230 | 1.68→1.58 | B | B | A | B |
| Example 7 | 68.0 | 9.0 | 115 | 230 | 1.75Stable transition | B | B | A | A |
| Example 8 | 67.5 | 6.0 | 130 | 225 | 1.69→1.83 | B | B | A | A |
| Example 9 | 68.8 | 6.0 | 120 | 200 | 1.72→1.82 | A | B | B | B |
| Example 10 | 67.2 | 6.0 | 130 | 230 | 1.72→1.80 | A | B | B | A |
| Example 11 | 67.8 | 6.0 | 130 | 220 | 1.72→1.86 | B | A | A | A |
| Example 12 | 68.2 | 6.0 | 130 | 210 | 1.75→1.89 | B | B | B | A |
| Example 13 | 68.3 | 6.0 | 140 | 210 | 1.88→2.02 | B | B | B | A |
| Example 14 | 67.1 | 6.0 | 120 | 210 | 1.75→1.83 | B | B | B | A |
| Example 15 | 99.1 | 6.0 | 130 | 205 | 1.75→1.85 | B | B | B | A |
| Example 1 | 68.1 | 6.0 | 120 | 225 | 1.59→1.93 | D | D | D | D: Deep scratch |
| Example 2 | 68.0 | 6.0 | 120 | 225 | 1.60→1.95 | D | D | D | D: Toner adhesion |
| Example 3 | 68.0 | 6.0 | 120 | 225 | 1.55→1.90 | D | D | D | D: Toner adhesion |
| Example 4 | 68.2 | 6.0 | 120 | 225 | 1.62→1.91 | D | D | D | D: Deep scratch |
| Example 5 | 68.2 | 6.0 | 120 | 225 | 1.71→1.88 | C | C | C | D: Deep scratch |
| Example 6 | 68.0 | 6.0 | 120 | 225 | 1.71→1.95 | D | D | C | D: Toner adhesion |
| Example 7 | 109.3 | 6.0 | 165 | 220 | 1.69→1.40 | B | B | A | B |
| Example 8 | 49.0 | 6.0 | 110 | 170 | 1.50→1.80 | D | D | D | D: Toner adhesion |

| | Under normal temperature and low humidity conditions | | | | |
|---|---|---|---|---|---|
| | Macbeth image density | Fogging | Toner-scattering | Dropout level | Surface condition of photoconductor |
| Example 1 | 1.70Stable transition | A | A | A | A |
| Example 2 | 1.68Stable transition | A | A | B | A |
| Example 3 | 1.67→1.60 | A | A | B | A |

TABLE 6-continued

| | | | | | |
|---|---|---|---|---|---|
| Example 4 | 1.65→1.70 | A | B | A | A |
| Example 5 | 1.60→1.69 | B | B | A | A |
| Example 6 | 1.54→1.44 | B | B | A | B |
| Example 7 | 1.67Stable transition | B | B | A | A |
| Example 8 | 1.60→1.74 | B | B | A | A |
| Example 9 | 1.60→1.69 | A | B | B | B |
| Example 10 | 1.60→1.67 | A | B | B | A |
| Example 11 | 1.60→1.74 | B | A | A | A |
| Example 12 | 1.63→1.77 | B | B | B | A |
| Example 13 | 1.75→1.89 | B | B | B | A |
| Example 14 | 1.65→1.73 | B | B | B | A |
| Example 15 | 1.65→1.75 | B | B | B | A |
| Example 1 | 1.48→1.81 | D | D | D | D: Deep scratch |
| Example 2 | 1.45→1.80 | D | D | D | D: Toner adhesion |
| Example 3 | 1.45→1.79 | D | D | D | D: Toner adhesion |
| Example 4 | 1.47→1.79 | D | D | D | D: Deep scratch |
| Example 5 | 1.55→1.73 | C | C | C | D: Deep scratch |
| Example 6 | 1.55→1.79 | D | D | C | D: Toner adhesion |
| Example 7 | 1.59→1.43 | B | B | A | B |
| Example 8 | 1.35→1.69 | C | C | D | D: Toner adhesion |

A: Excellent,
B: Involves no problem in practical sense,
C: Involves problem in practical sense,
D: Impossible to use As described above, according to the present invention, there can be obtained a toner that attains excellent low-temperature fixing property, color mixing property, and high-temperature offset resistance while attaining excellent developing property, transferring property, fixing property, and endurance under various environmental conditions even if a fixing means is used in which oil for preventing a high-temperature offset is not used or somewhat used.

What is claimed is:

1. A toner comprising toner particles containing at least a binder resin, a colorant and a release agent, and silica particles, wherein:

the toner has a peak temperature of maximum endothermic peak in the range of 60 to 100° C. in a temperature ranging from 30 to 200° C. of an endothermic curve of differential scanning calorimetry (DSC) measurement;

the silica particles contain a titanium element; and the silica particles satisfy the following expressions, $$0.7 \leqq (Ia_1/Ib_1) \leqq 2.0; \text{ and}$$

$$0.7 \leqq (Ia_2/Ib_2) \leqq 2.0$$

where $Ia_1$ represents a maximum intensity in the case of 2θ=25.3 deg, $Ib_1$ represents a mean intensity in the cases of 2θ=25.3 deg+2.0 deg. and of 2θ=25.3 deg.−2.0 deg., $Ia_2$ represents a maximum intensity in the case of 2θ=27.5 deg and $Ib_2$ represents a mean intensity in the cases of 2θ=27.5. deg+2.0 deg. and of 2θ=27.5 deg.−2.0 deg.

2. The toner according to claim 1, wherein the silica particles contain a titanium compound, and contain 0.1 to 20 parts by mass of titanium compound with respect to 100 parts by mass of the silica particles.

3. The toner according to claim 1, wherein the silica particles are sintered in a gaseous phase.

4. The toner according to claim 1, wherein the silica particles are subjected to a hydrophobing treatment with at least a silazane compound.

5. The toner according to claim 1, wherein the silica particles have primary average particle diameter of 10 to 400 nm.

6. The toner according to claim 1, wherein a BET of the silica particles is in the range of 5 to 300 $m^2/g$.

7. The toner according to claim 1, wherein the silica particles are prepared by sintering a mixture that contains a halogen-free siloxane and a volatile titanium compound.

8. The toner according to claim 1, wherein the binder resin is selected from the group consisting of:

(a) a polyester resin;

(b) a hybrid resin including a polyester unit and a vinyl copolymer unit; and (c) a mixture of the polyester resin and the hybrid resin.

9. The toner according to claim 1, wherein the binder resin is a hybrid resin including a polyester unit.

10. The toner according to claim 1, further comprising an inorganic fine particle in addition to the silica particle.

11. The toner according to claim 1, wherein the toner has a weight average particle diameter of 3 to 9 μm.

12. The toner according to claim 1, further comprising a negative charge-controlling agent.

13. The toner according to claim 12, further comprising an aluminum complex of di-tert-butylsalicylic acid.

* * * * *

UNITED STATES PATENT AND TRADEMARK OFFICE

CERTIFICATE OF CORRECTION

PATENT NO. : 7,115,349 B2
APPLICATION NO. : 10/722463
DATED : October 3, 2006
INVENTOR(S) : Wakashi Iida et al.

It is certified that error appears in the above-identified patent and that said Letters Patent is hereby corrected as shown below:

ON THE TITLE PAGE ITEM -57- ABSTRACT:

Line 14, "2θ=27.5 deg" should read --2θ=27.5 deg.--.

COLUMN 9:

Line 58, "1.00" should read --100--.

COLUMN 19:

Table 2, "$I_{\theta+2.0deg}$ cps" should read --$I_{2\theta+2.0deg}$ cps--.

COLUMN 21:

Line 55, "75 $m^2/g$)" should read --75 $m^2/g$).--.

Signed and Sealed this

Twenty-sixth Day of June, 2007

JON W. DUDAS
*Director of the United States Patent and Trademark Office*